United States Patent [19]

Jacobson et al.

[11] 3,946,528

[45] Mar. 30, 1976

[54] INSULATED BUILDING PANELS AND STRUCTURE CONSTRUCTED THEREWITH

[75] Inventors: Isadore A. Jacobson; Michael D. Sepate, both of Cincinnati, Ohio

[73] Assignee: B. & J. Jacobs Co., Inc., Cincinnati, Ohio

[22] Filed: Mar. 31, 1975

[21] Appl. No.: 563,799

Related U.S. Application Data

[63] Continuation of Ser. No. 403,812, Oct. 5, 1973, abandoned.

[52] U.S. Cl. ..... 52/79; 52/145; 52/262; 52/265; 52/406; 52/582; 52/619; 52/758 B

[51] Int. Cl.[2] ..... E04H 1/12; E04B 1/88

[58] Field of Search ..... 52/144, 145, 270, 262, 52/406, 615, 398, 758 B, 79, 404, 264, 265, 268, 269, 582, 619, 620; 181/33 G

[56] References Cited

UNITED STATES PATENTS

| | | | |
|---|---|---|---|
| 874,939 | 12/1907 | Clayton et al. | 52/262 |
| 1,675,102 | 6/1928 | Holland | 181/33 G |
| 1,802,600 | 4/1931 | Hatch | 52/404 X |
| 1,819,287 | 8/1931 | Goerz | 52/758 B |
| 2,057,444 | 10/1936 | O'Reilly | 52/79 X |
| 2,160,066 | 5/1939 | Frische | 52/144 X |
| 2,161,708 | 6/1939 | Heerwagen | 181/33 G |
| 2,211,644 | 8/1940 | Buck et al. | 52/262 X |
| 2,291,116 | 7/1942 | Streater | 52/262 |
| 2,291,913 | 8/1942 | Nicolai | 52/398 |
| 2,293,181 | 8/1942 | Terman | 181/33 G |
| 2,328,928 | 9/1943 | Sherron | 52/79 X |
| 2,579,157 | 12/1951 | Price, Sr. et al. | 52/619 |
| 2,665,781 | 1/1954 | Battles et al. | 52/619 X |
| 2,821,898 | 2/1958 | Kennedy | 181/33 G |
| 2,927,665 | 3/1960 | Hauf | 52/264 X |
| 3,072,183 | 1/1963 | Barbier et al. | 181/33 G |
| 3,094,198 | 6/1963 | Haskins | 52/619 |
| 3,186,526 | 6/1965 | Sidener | 52/404 |
| 3,273,297 | 9/1966 | Webe | 52/404 |
| 3,310,926 | 3/1967 | Brandreth et al. | 52/582 |
| 3,343,314 | 9/1967 | Smith | 52/584 X |
| 3,363,391 | 1/1968 | Bordenave | 52/615 X |
| 3,430,405 | 3/1969 | Alder et al. | 52/404 |
| 3,670,466 | 6/1972 | Lynch | 52/615 X |

FOREIGN PATENTS OR APPLICATIONS

| | | | |
|---|---|---|---|
| 546,880 | 8/1942 | United Kingdom | 52/145 |
| 871,506 | 3/1953 | Germany | 52/144 |
| 593,133 | 10/1947 | United Kingdom | 52/264 |
| 465,203 | 8/1951 | Italy | 52/619 |

*Primary Examiner*—Ernest R. Purser
*Assistant Examiner*—Leslie A. Braun
*Attorney, Agent, or Firm*—John G. Schenk

[57] ABSTRACT

The disclosure illustrates an enclosure constructed of unique building panels. The panels are joined so as to provide an airtight enclosure for housing of air conditioning equipment, machinery and the like. The individual panels provide sound attenuation. Structural reinforcing is provided in each panel so as to eliminate the need for an enclosure framework on which the panels are to be secured.

28 Claims, 30 Drawing Figures

INSULATED BUILDING PANELS AND STRUCTURE CONSTRUCTED THEREWITH

This is a continuation of application Ser. No. 403,812, filed Oct. 5, 1973, now abandoned.

BACKGROUND OF THE INVENTION

This invention relates generally to building construction and more particularly to prefabricated building panels which cooperate one with another to form a self-contained and airtight enclosure.

In the past, many attempts have been made to provide panel structures which can be fabricated at a plant facility, and, when so formed, the panel units can be adequately prepared for shipping to the building site and then easily assembled to form the desired structure. In the prior art prefabricated panels, such panels have generally required the necessity of studding and the like on which the panels are to be secured. When such studding is not used, the complexity of the panels increases significantly, thereby increasing the relative cost of the same. In addition, when such prior prefabricated panels have been assembled to form the desired building, it is extremely difficult to remove individual panels for repair or replacement. It has further been a problem with the prior panel structures to provide an enclosure made from such panels which is completely airtight so as to prevent air leakage therethrough, as well as to provide adequate sound attenuation without significantly increasing the cost and size of such panels.

Accordingly, it is an object of this invention to provide a prefabricated panel construction which will enable one to readily assemble the panel units to form a structure of the desired configuration without the use of a conventional vertical and horizontal studding, thus, reducing, materially, the cost in erecting such a structure.

It is an object of this invention to provide a panel structure, comprising an interior and exterior facing, with an insulating material extending therebetween which will serve as an effective means to properly insulate the structure without the use of an extraneous material to effect the desired insulation.

And yet a further object of this invention is to provide prefabricated building panels having reinforcing structures therein and wherein each structure is assembled and the panels secured to the other from the inside of the structure.

And still another object of this invention is to provide prefabricated panels which when assembled together to define an enclosed structure, such structure will be airtight and will provide proper sound attenuation.

SUMMARY OF THE INVENTION

This invention provides improved prefabricated building panels which may be assembled one to the other to provide an airtight, sound attenuated enclosure. The building panels are formed with inner and outer facings having an insulating material therebetween. Each panel is formed with cooperating edges for coaction with cooperating edges of adjoining panels for securing the panels together. The reinforcing members are mounted within each panel to provide the necessary strength for supporting the enclosure. Suitable means are provided in individual panels to provide communication with the interior of the enclosure while retaining the airtight feature of the enclosure.

Other objects, details, uses, and advantages of this invention will become apparent as the following description of the exemplary embodiments thereof presented in the accompanying drawings proceeds.

BRIEF DESCRIPTION OF THE DRAWINGS

The accompanying drawings show present exemplary embodiments of this invention in which.

DESCRIPTION OF ILLUSTRATED EMBODIMENTS

Figure 1:
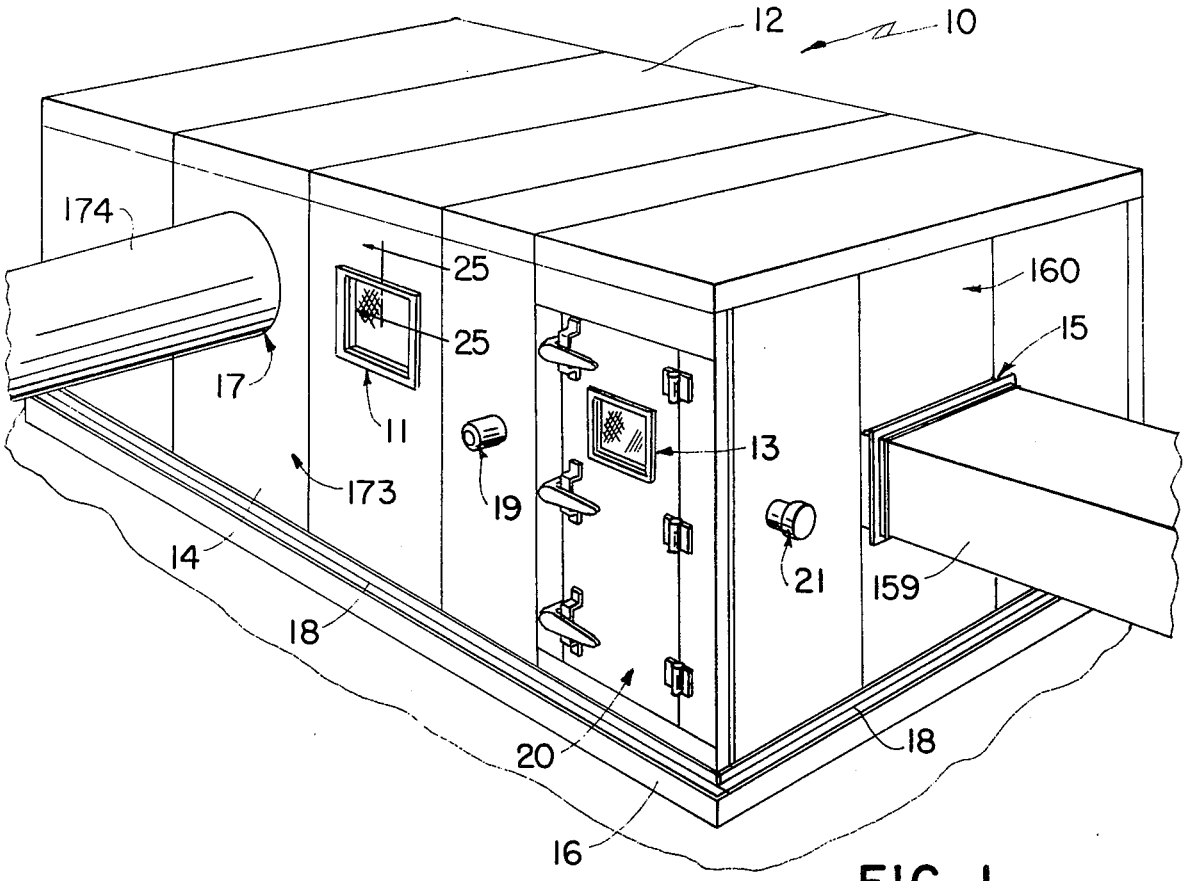
FIG. 1 is a perspective view illustrating one exemplary embodiment of this invention showing a typical enclosure constructed through the use of various prefabricated building panels.

Reference is now made to FIG. 1 of the drawings which illustrates one exemplary embodiment of a typical enclosure constructed with panels of this invention, which is designated generally by the reference numeral 10. The enclosure 10 is constructed from a plurality of ceiling panels designated generally as 12 and various wall panels designated generally as 14. The enclosure 10 is constructed on a suitable base 16 of concrete or the like to which angle irons 18 have been secured by known methods. The wall panels are secured at their lower ends by suitable means such as bolts and the like to the angle irons 18 as illustratively shown in FIGS. 1, 5 and 10. Referring again to FIG. 1, it is seen that the enclosure 10 includes a door 20, windows 11 and 13, rectangular bellmouth 15, round bellmouth 17, conduit connection 19 and a test plug 21. The detailed description of the aforementioned examples follows.

All of the panels of the enclosure 10 generally comprise two facings securing an insulating material therebetween. On those panels forming the peripheral wall of the enclosure, the two facings of the panel include an exterior facing and an interior facing. For illustrative purposes only, it may be noted that the exterior facing of the panels, i.e., the facing to the outside atmosphere, is formed of 16 gauge galvanized solid material and the interior facing is formed of 18 gauge galvanized perforated material. Any suitable insulating material may be used and a fiberglass insulation has been found to provide excellent results.

Figure 2:
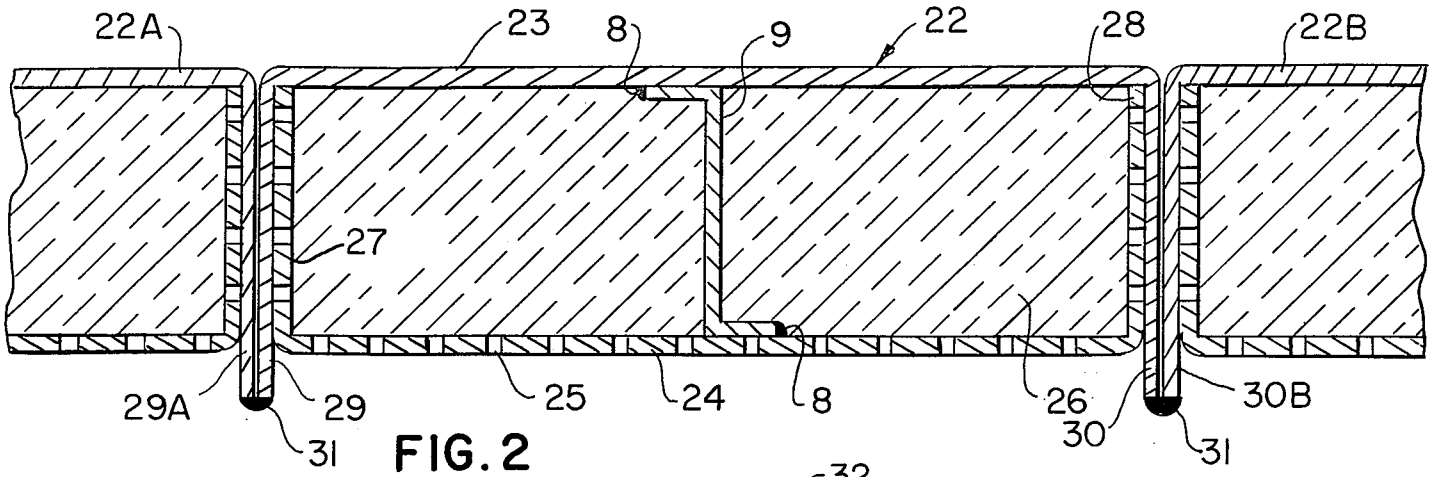
FIG. 2 is a sectional view illustrating the standard wall panel and particularly showing the means for securing adjoining panels.

Referring now to FIG. 2, a standard peripheral wall panel designated generally as 22 is shown. The panel 22 is comprised of an outer or external facing 23 of a solid material and an inner facing 24 having a plurality of perforations 25 therethrough. The insulating material, such as fiberglass or the like, is generally shown as 26. The panels 22 are generally of the pan type and may be conveniently prefabricated. The perforated facing 24 is formed with the edges 27 and 28 bent inwardly so as to form a U-shaped section. The outer facing of solid material 23 is similarly formed in a U-shaped manner so as to overlap the edges 27 and 28. The edge portions 29 and 30 of the facing 23 project inwardly beyond the plane of the surface of the facing 24. A stiffener 9 having a substantially Z-shape is secured between the facings 23 and 24 by suitable means such as tack brazing shown generally as 8 so as to provide added strength to the panel 22. Each panel hereinbelow described is formed with similar stiffeners secured therein in a similar manner and may not necessarily be specifically described again. Each panel 22 is constructed so as to provide an airtight enclosure. In this regard, it should be noted that all corners and seams of each individual panel, hereinafter described, are continuously Everdur brazed to make the panel airtight. As an example, the corners and seams in FIG. 4 designated with the letter "b" are continuously Everdur brazed. This construction permits each panel described herein to withstand 12'' static pressure and further provides excellent soundproofing. Sound may be transmitted through the perforated facing 24 and into the insulating material 26 which absorbs much of the sound. That portion of the sound not absorbed bounces off the solid facing 23 and into the insulation 26 in the opposite direction whereby substantially all of the sound is absorbed. The facings 23 and 24 are secured one to the other at the seams by suitable means such as brazing.

The panel 22 may be connected with adjoining panels 22A and 22B of a similar construction. It is seen that the extending edges 29 and 30 of panel 22 about complementally formed edges 29A and 30B. The respective edges are secured one to the other by continuous Everdur brazing. The brazed head is shown as 31. It should be noted that the cooperating edges are all projecting inwardly and, therefore, the panels may be joined together from the area within the enclosure. This facilitates constructing the enclosure in very tight areas.

Figure 3:
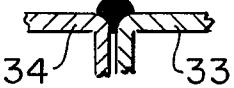
PRIOR ART FIG. 3
FIG. 3 is an example of prior art joining method.

FIG. 3 illustrates the prior art method of securing metal panels one to the other wherein the panels were secured on the exterior side continuous Everdur brazing or the like 32. Previously, the braze 32 was placed on the exterior between the rounded corners of adjoining walls 33 and 34. The braze 32 would flow into the crevice therebetween. In order to remove a panel, the braze 32 must be ground out of the panel which is extremely time consuming and difficult. In addition, brazing of the panels at the point would generally cause a burning or charring of the insulation within the panels and further would not permit expansion or contraction of the panels.

As seen in FIG. 2, the brazing operation is performed at a distance from the insulating material 26 and, therefore, no burning or charring of the insulation occurs. Through the use of the projecting edges 29 and 30, removal of any single panel after construction is greatly facilitated. Hence, to remove the panel 22, it is only necessary to grind off the brazing material 31 along the interior seam. It should be noted that the seams formed by adjoining panels are continuous Everdur brazed their entire length so as to provide an airtight enclosure. It can be further noted that the joining of the panels as seen in FIG. 2 will allow for minor expansion and contraction of the panels. In essence, the panels may slightly flex about the seams formed by the brazing operation.

Figure 4:
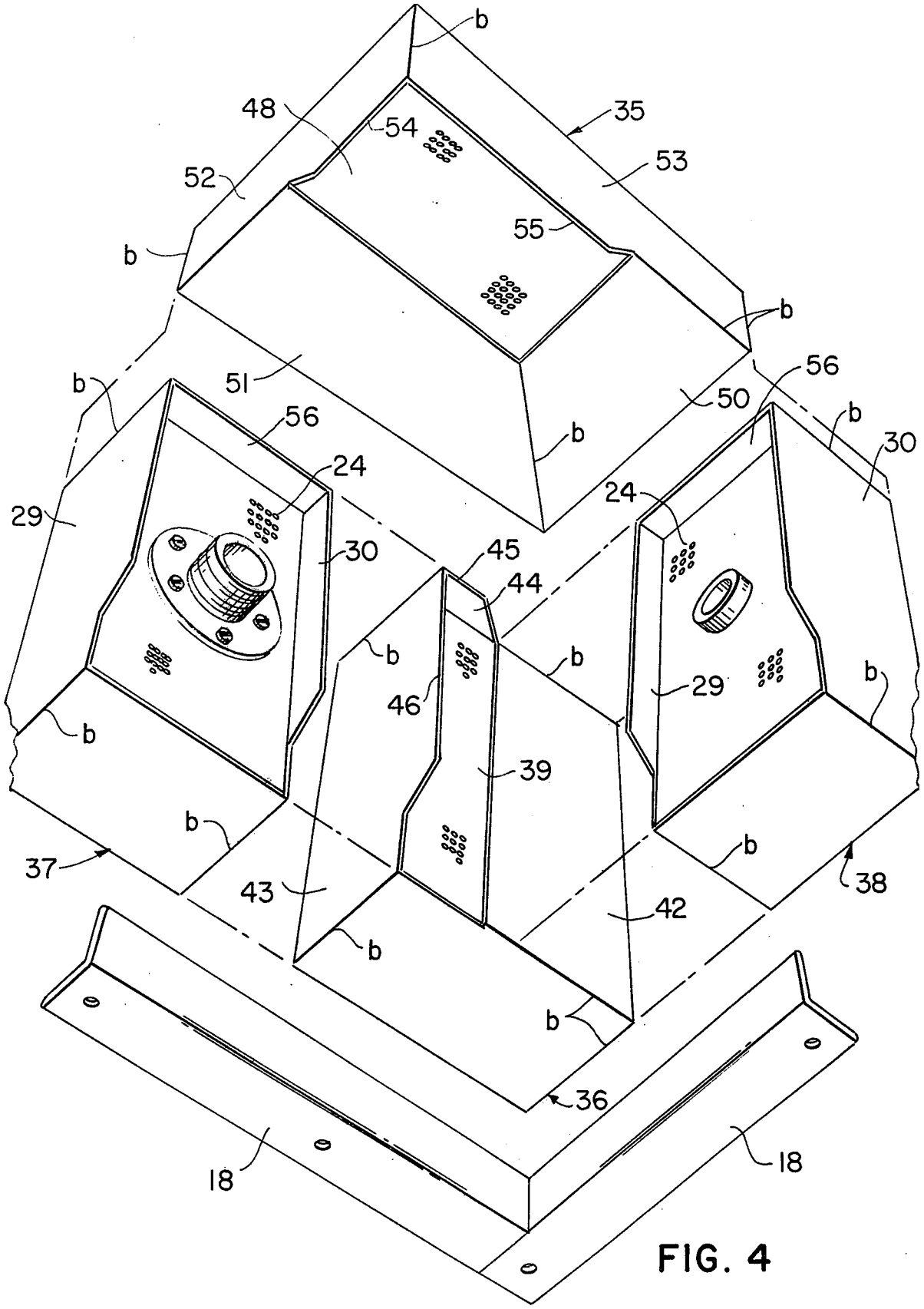
FIG. 4 is an exploded view of an illustrative corner panel.
Figure 5:
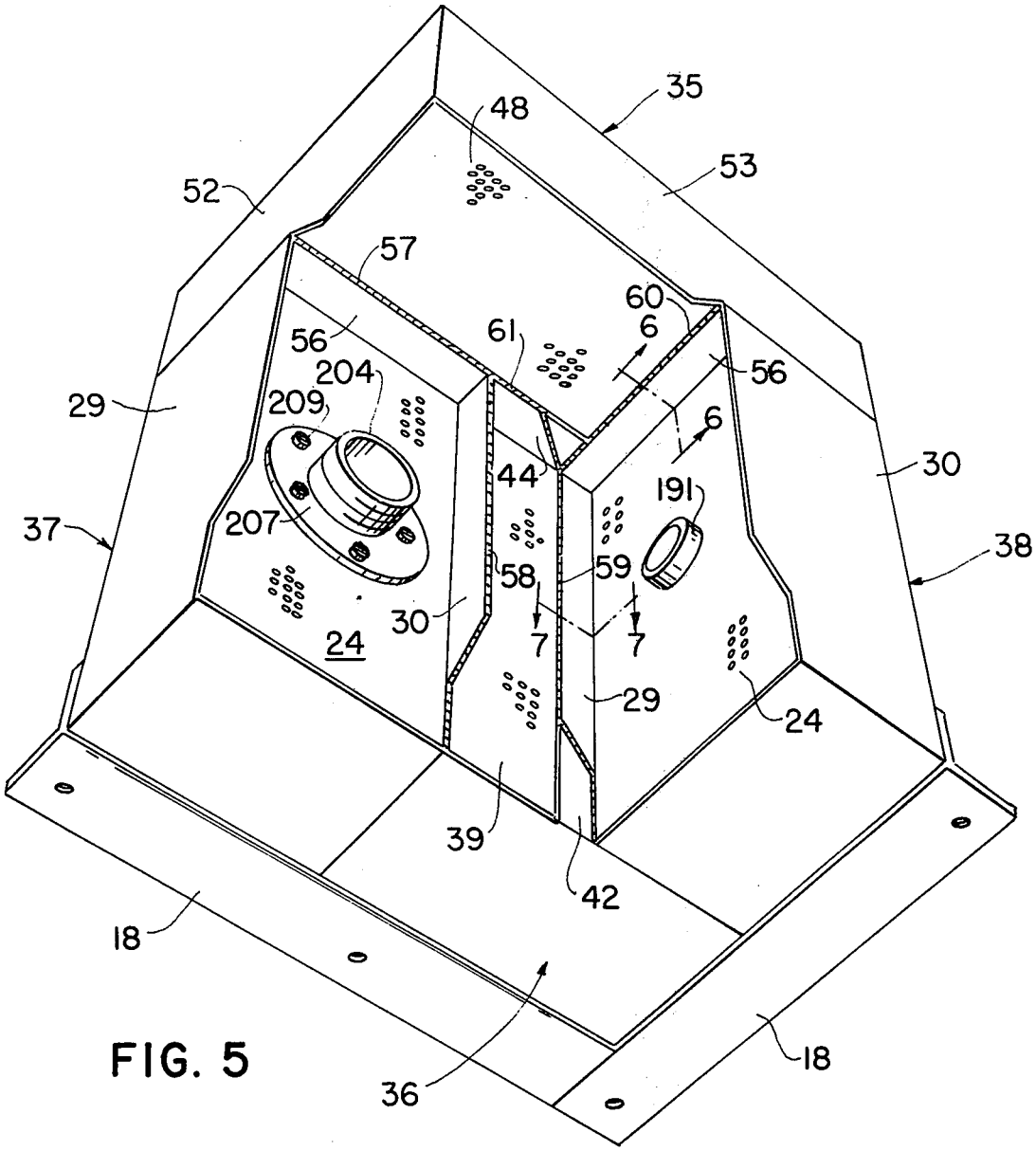
FIG. 5 is the assembled corner panel of FIG. 4 particularly showing the secured seams between the respective panels.

Referring now to FIGS. 4–7, a typical corner installation of the enclosure 10 will be described. It should be particularly noted that the illustrations of FIGS. 4 and 5 are illustrative only and the vertical height of such panels has been significantly decreased in order to illustrate the assembled panels including top and side walls as shown in the perspective view. As particularly seen in FIG. 4, there is shown a ceiling panel 35, a corner panel 36, and wall panels 37 and 38. Each of the panels basically comprises the solid outer facing and a perforated inner facing, the required stiffener and insulating material, as hereinbefore described.

Figure 7:
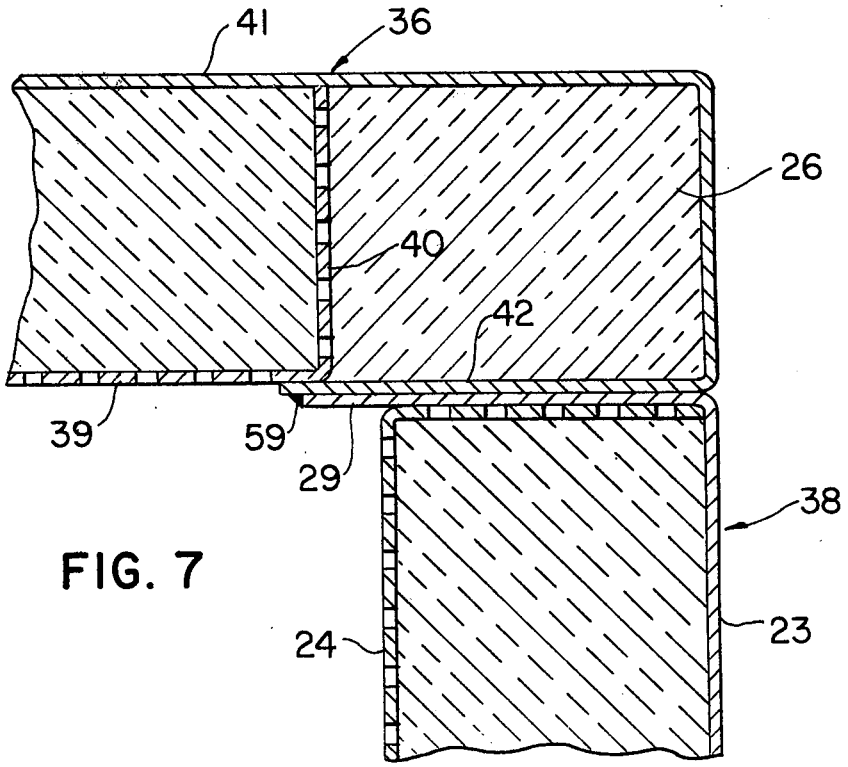
FIG. 7 is a sectional view taken along the line 7—7 of FIG. 5.

The corner panel 36, as best seen in FIGS. 4 and 7, includes the perforated facing 39 having the edge 40 serving as a stiffening member. The solid outer facing 41 extends beyond the edge 40 and provides a solid return face 42. Additional insulating material 26 is enclosed within that portion defined by the return face 42, edge 40 and outer facing 41. The corner panel 36 is provided with solid return faces 43 and 44 having a mitered edge 45 and 46.

Figure 6:
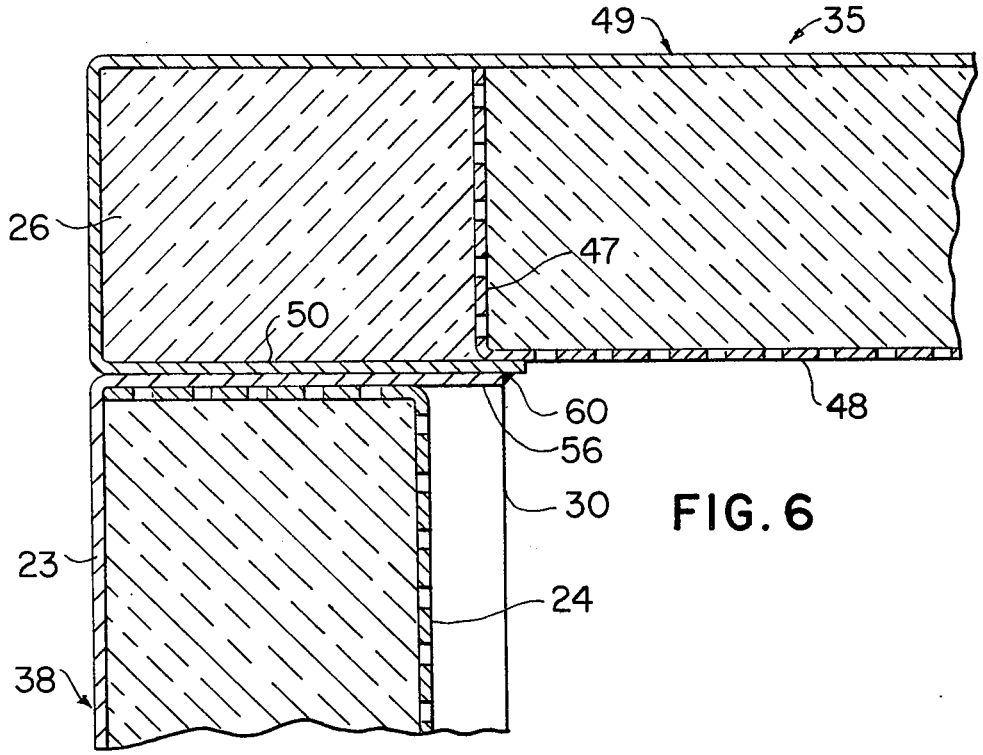
FIG. 6 is a sectional view taken along the line 6—6 of FIG. 5.

The ceiling panel 35 is formed in a similar manner such that the edge 47 of perforated facing 48 serves as a stiffening member for the panel 35. The outer facing 49 extends beyond the stiffener 47 to provide a solid return 50 thereby enclosing the insulating material 26 therein, as seen in FIG. 6. In addition, as seen in FIG. 4, the ceiling panel 35 is provided with a second solid return 51 on the inner side thereof. The outer facing 49 also provides solid faces 52 and 53 having mitered edges 54 and 55, respectively.

The wall panels 37 and 38 may be of the standard construction as described with reference to FIG. 2 in that each panel will have a solid outer facing 23 and perforated inner facing 24. Each panel is provided with solid return faces 29 and 30, as well as a top return face 56, each having a defined edge. It may be seen that the faces 29 and 30 are formed with mitered edges.

Referring now particularly to FIG. 5, the respective panels are shown in the assembled condition. In order to provide the airtight construction required, all of the exposed seams of the respective panels must be sealed such as by Everdur brazing. In other words, a continuous bead of the Everdur braze joins the entire seam between respective panels. It is seen that panel 37 is connected with panel 36 and panel 35 by horizontal Everdur braze bead 57 and vertical bead 58. It may be noted at this point that the use of the mitered edge permits panels to be sealed together for the entire vertical height when the panels are in place. Thus, if the respective solid faces were not mitered, but extended the full length, there would be an air space the distance of the projecting edge which would not be sealed by the brazing process. It should be further noted that when the panels are in the assembled condition, solid faces abut solid faces of the adjoining panel.

Panel 38 abuts against return face 42 of corner panel 36 and is sealed thereto by the vertical bead 59. Panel 38 is connected with the ceiling panel 35 by abutting return face 56 against return face 50 and brazing the two panels together by the horizontal bead 60. To keep the airtight sealing construction, it is only necessary to braze the remaining seam between the corner panel 36 and ceiling panel 35 as represented by the hoizontal mitered bead 61.

Figures 8, 9:
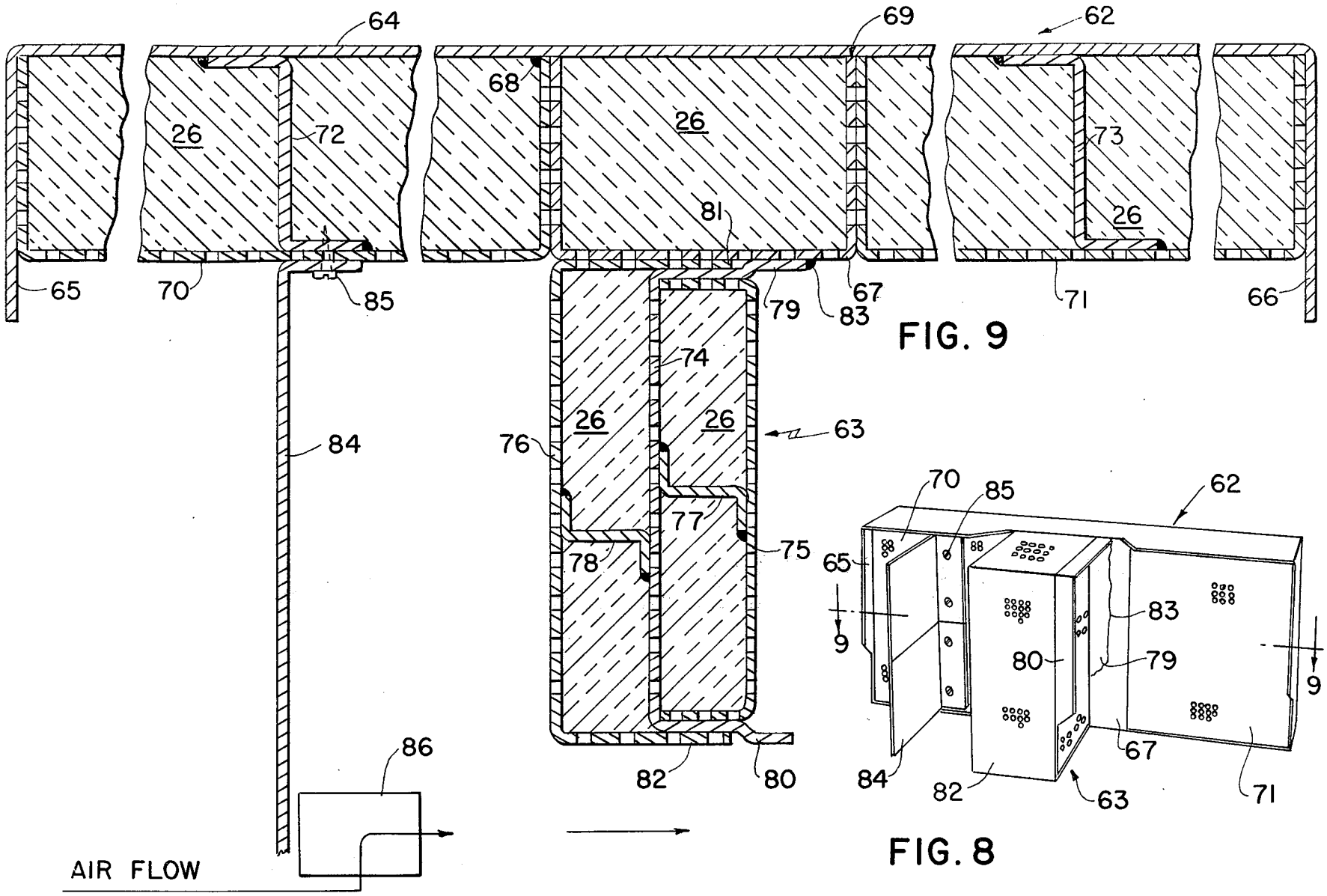
FIG. 8 is a perspective view of an illustrative panel having blank off and stiffener members.
FIG. 9 is a sectional view taken along line 9—9 of FIG. 8.

Reference is made now to FIGS. 8 and 9 which illustrate a standard wall panel modified so as to cooperate with a septum panel. The modified wall panel is designated generally by the numeral 62 and septum panel is designated generally as 63. The wall panel 62 is formed with the solid outer facing 64, the edges thereof providing solid return faces 65 and 66. Intermediate the ends of the wall panel 62 is secured a solid blank-off member 67. It is necessary that the blank-off member 67 be installed airtight to prevent the escape of any air therethrough. Accordingly, the blank-off 67 may be secured along one edge to the facing 64 with a continuous bead of Everdur braze 68. The other edge of the blank-off member 67 may then be tack brazed and sealed at 69 by known method. Insulation 26 is secured within the area defined by the blank-off 67 and outer facing 64. Perforated facings 70 and 71 define the inner facings of the panel 62. Stiffeners 72 and 73 are secured in the panel 62 as hereinbefore described. Insulating material is carried within the areas defined by the respective inner facings 70 and 71 and the outer facing 64 so as to provide the necessary sound attenuation.

The septum panel 63 is used to provide sound attenuation between interior chambers of the enclosure. Accordingly, the septum 63 is constructed with a solid facing 74 having insulating material 26 on both sides thereof. Perforated facing 75 forms one interior wall surface and perforated facing 76 forms the outer interior wall surface of the septum panel 63. Stiffeners 77 and 78 are secured between the facing 74 and facings 75 and 76. It is seen that the edges of the facing 75 fit within the solid return faces 79 and 80 of the facing 74. The return faces 79 and 80 are formed with a staggered shape so as to receive return faces 81 and 82 of facing 76. The septum is thus provided at each edge with an overlap of three faces to provide added rigidity to the septum panels. The septum panel 63 is secured to the blank-off 67 by a continuous seam of Everdur braze shown generally as 83 which provides an airtight seal between the septum panel 63 and the wall panel 62.

In a typical installation, a close-off panel 84 may be secured to the panel 62 through the use of screws or the like 85 projecting inwardly through the facing 70 to escape the stiffener 72. Suitable gaskets or seals (not shown) may be inserted between the close-off panel 84 and facing 70. The close-off panel 84 may be used to close off or define an equipment area such as the air intake or the like. In this instance, it may be desirable to transmit the air flow from the equipment area past the close-off panel 84 through suitable coil or fan or the like diagrammatically shown as 86 and through an aperture formed by septum panels 63 as indicated by the arrows. In this instance in order to provide a completely airtight construction, it may be necessary to provide a continuous seal by brazing and other suitable means between the stiffener 72 and the respective facings 64 and 70.

Where it is desirable to provide rooms within the enclosure 10, septum panels are utilized as the room dividers. Each septum panel is generally formed as hereinabove described with reference to FIG. 9. In other words, each septum panel has a solid facing extending through the center of the panel and provides the return faces utilized to secure the septum panel to an adjoining panel. Insulating material is supported on each side of the solid facing and perforated facing members define the wall surface for the areas defined by the respective septum panels. Such construction provides excellent sound attenuation between adjoining rooms since the insulating material and solids facing will prevent any sound from being transmitted through the respective septum panels.

Figures 10, 11:
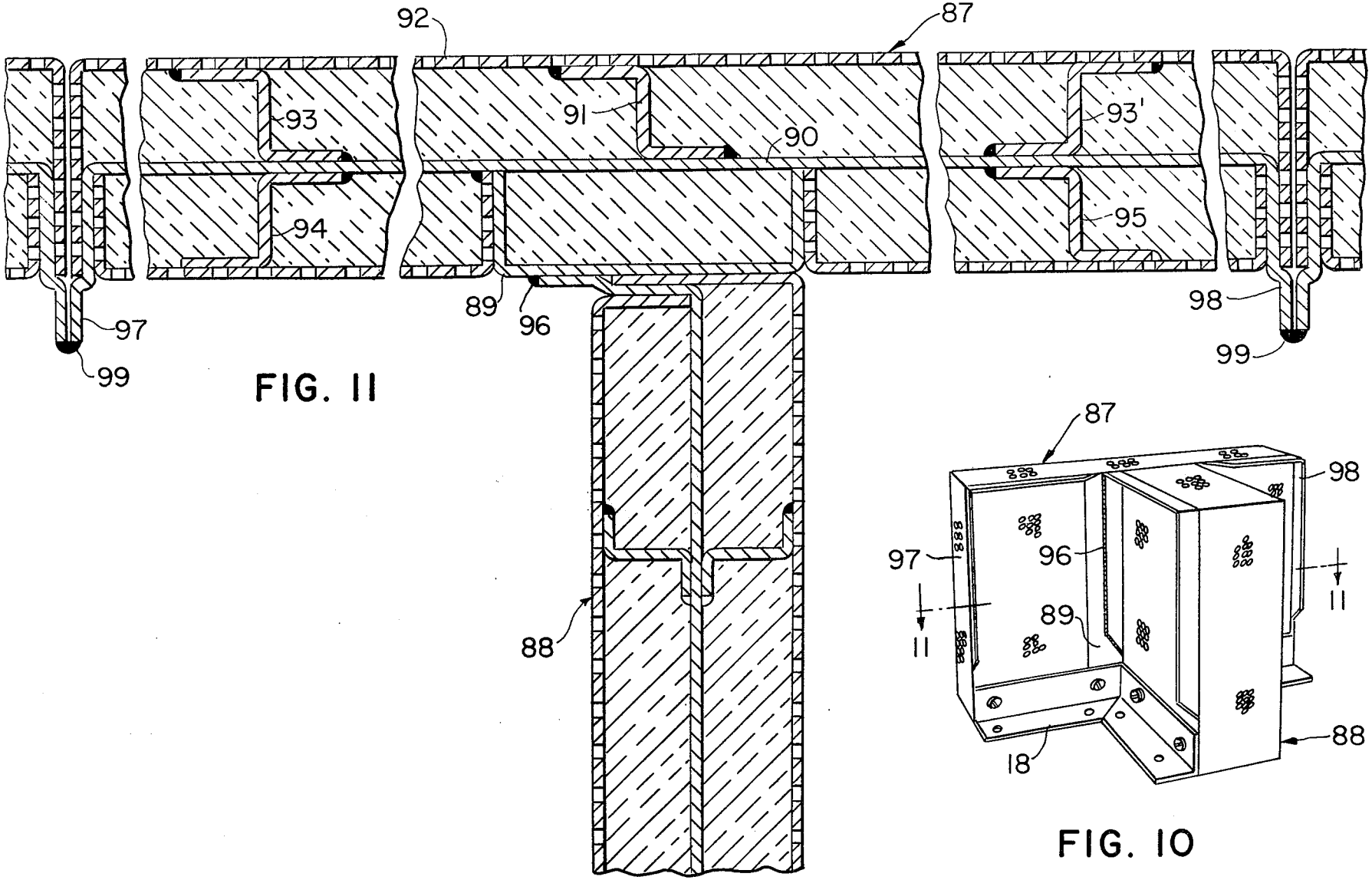
FIG. 10 is a perspective view illustrating an exemplary septum panel secured to a septum panel.
FIG. 11 is a sectional view taken along line 11—11 of FIG. 10.

An exemplary embodiment of septum panels being used as the walls or room dividers is illustrated in FIGS. 10 and 11. It is, of course, necessary to secure the respective septum panels designated generally as 87 and 88 to angle irons 18 by suitable means such as bolts or the like. The angle irons 18 are secured to the floor. The septum panel 87 is modified in the same manner that the wall panel 62 (FIG. 9) is modified. A solid blank-out member 89 is secured intermediate the ends of panel 87. The blank-off member 89 is sealingly secured to the solid facing 90 in a manner as hereinabove described with regard to the panel 62. An added stiffener member 91 is secured between the facing 99 and perforated facing 92 opposite the blank-off member 88 so as to provide the necessary strength and rigidity for the septum panel 87. The stiffeners 93 and 93' may be secured opposite the stiffeners 94 and 95 to provide additional strength rather than to have the respective stiffeners staggered, as shown in FIG. 9. Septum panel 88 is secured to the blank-off member 89 of the modified septum panel 87 through the use of a continuous bead of Everdur braze 96.

As previously described, the solid facing of each septum panel provides a solid face which is used to secure that respective panel to an adjoining panel. As seen in FIG. 11, the solid facing 90 of septum panel 87 provides solid return faces 97 and 98. In securing septum panels lying in the same plane, the respective return faces of adjoining panels complement and abut one another. Thus, in FIG. 11, the septum panel 87 is secured to adjacent septum panels lying in the same plane through the use of a continuous bead of Everdur braze 99 connecting each of the abutting return faces.

Figure 12:
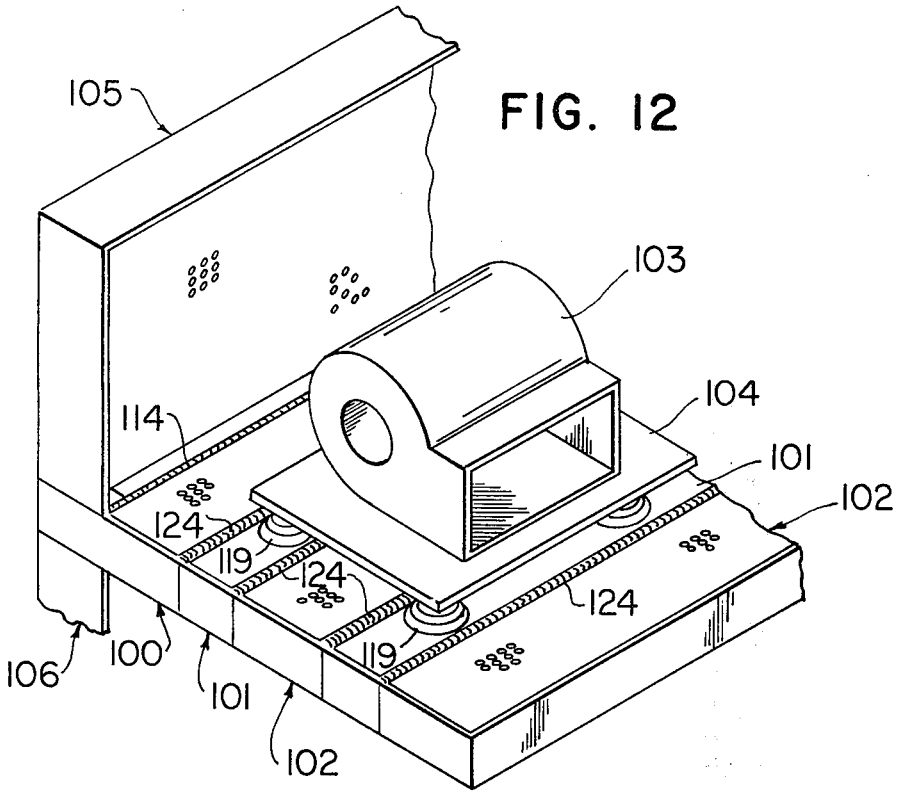
FIG. 12 is a perspective view particularly showing the mounting of a piece of equipment on a floor panel which is connected with a wall panel.

In some instances it may be desirable to support equipment above the base floor. In this case, septum type panels form a chamber floor. Referring to FIG. 12, a plurality of septum type panels designated generally as 100, 101 and 102 defines a chamber floor for supporting a piece of equipment, such as a centrifugal fan 103, which is carried by a supporting plate 104.

Figure 13:
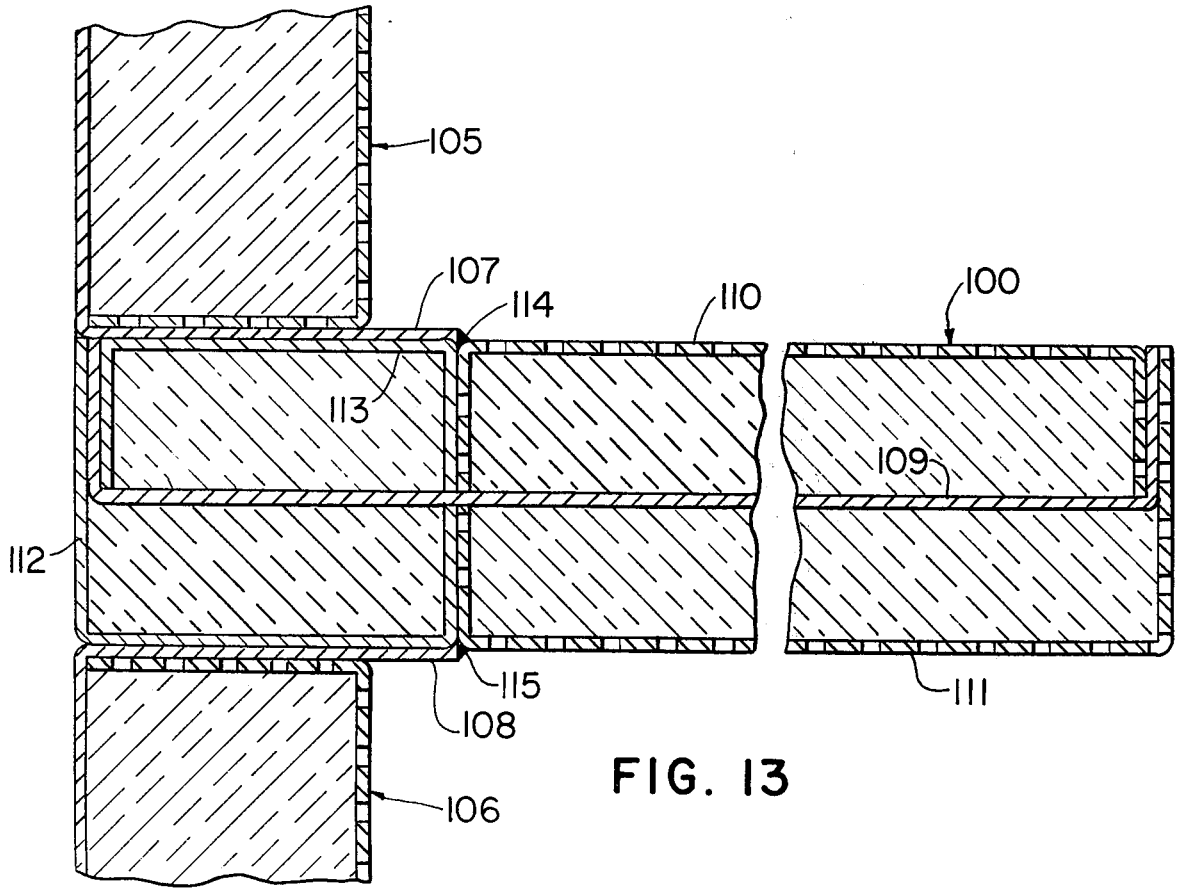
FIG. 13 is a sectional view of the floor and wall panels of FIG. 12.

Referring now particularly to FIGS. 12 and 13 it is seen that the septum type panel 100 is mounted between a pair of standard wall panels designated generally as 105 and 106. The wall panels 105 and 106 may be constructed as hereinabove described with particular reference to FIG. 2, it being sufficient here to state that the respective wall panels include solid return faces 107 and 108.

As seen in FIG. 13, the septum panel 100 is seen to be of a modified septum construction. The panel 100 includes the center solid facing 109 having perforated facings 110 and 111 secured thereto as previously described. Solid facing members 112 and 113 of the 16 gauge galvanized material are secured to the center facing 109 so as to provide solid return faces for the septum panel 100. It may be noted that in all of the septum type panels which are used in the floor the projecting return faces of the solid center facing have been formed flush with the respective perforated facing so as to prevent a relatively flat floor surface. The panel 100 is secured to the respective wall panels 105 and 106 by a continuous bead of Everdur braze. Thus a continuous bead of Everdur braze 114 secures panel 105 to solid facing member 113 and braze 115 secures the panel 106 to the solid facing member 112.

Figure 15:
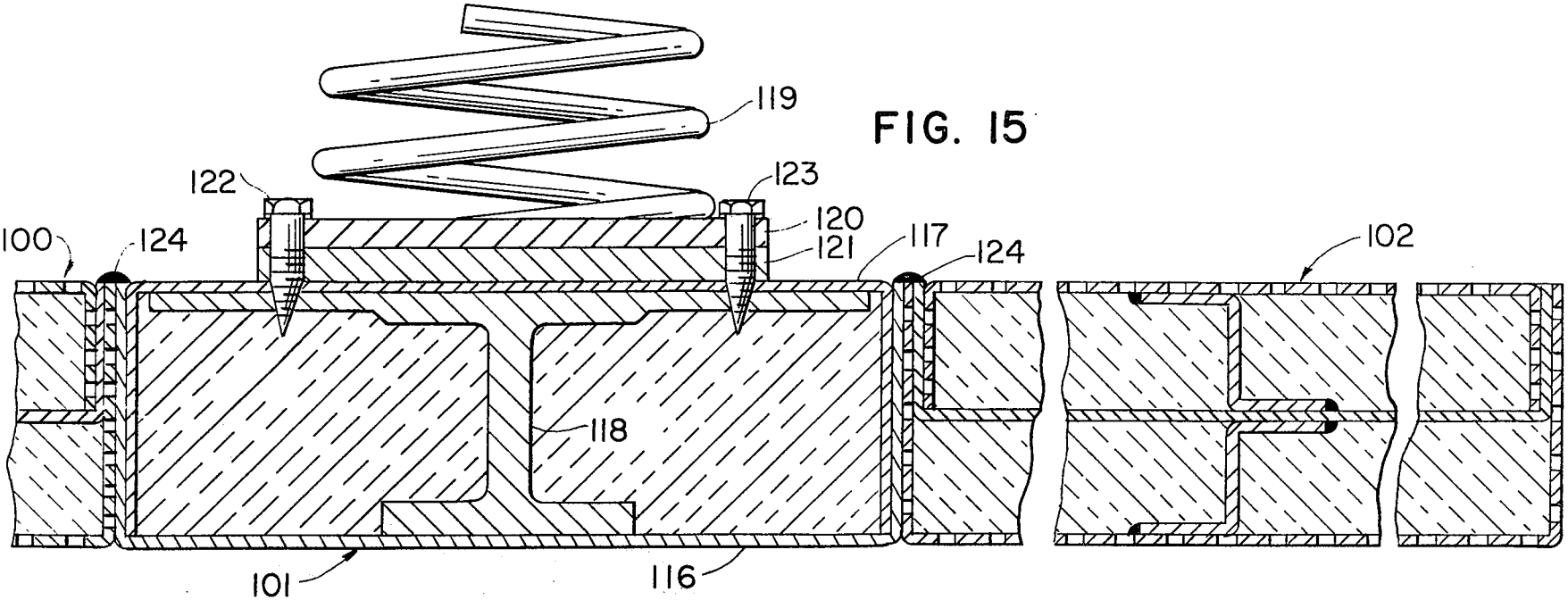
FIG. 15 is a sectional view taken along line 15—15 of FIG. 14.
Figure 14:
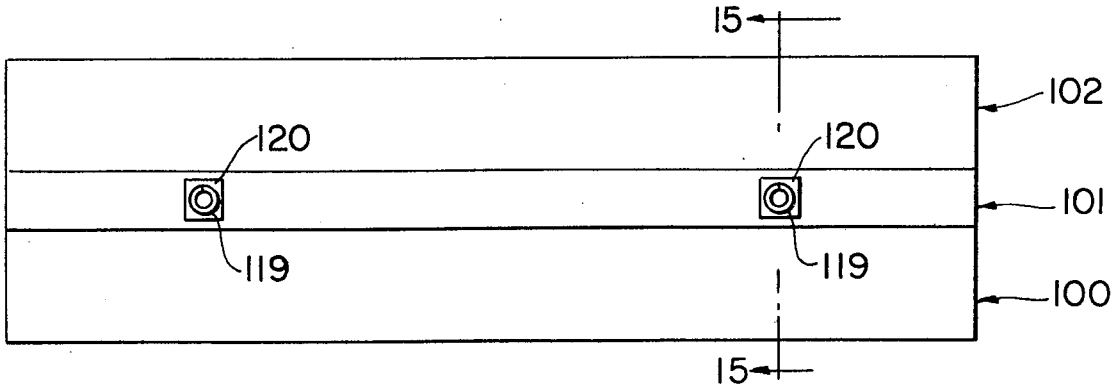
FIG. 14 is a plan view illustrating the floor panels of FIG. 12.

The equipment is supported directly on supporting panels 101. As seen in FIG. 15, the supporting panel 101 is constructed of solid facings 116 and 117 on both sides forming the upper and lower surfaces of the panel. Secured within the support panel 101 is a suitable steel reinforcing member such as an extended I-bar or the like 118. The size and shape of the member 118 will vary depending on the weight to be carried thereby. In the illustrative embodiment shown, the supporting plate 104 is carried by a plurality of resilient means such as springs or the like 119. The springs 119 are secured to a steel plate or the like 120 which is carried by an isolator pad 121 of a suitable material such as neophrene, fiberglass, or the like. The plate 120 and pad 121 are held in place by suitable means, such as self-tapping bolts 122 and 123. Self-tapping bolts are well known in the art and the operation thereof need not be described herein.

The panel 102 may be a standard septum panel, as hereinbefore described, with the exception that the projecting solid faces have been formed flush with the surface of the perforated facing. Thus, as seen in FIG. 15, the respective panels 100, 101 and 102 are secured one to the other through the use of a continuous bead of Everdur braze, shown generally at 124, along the seam formed by the adjoining panels.

Figure 16:
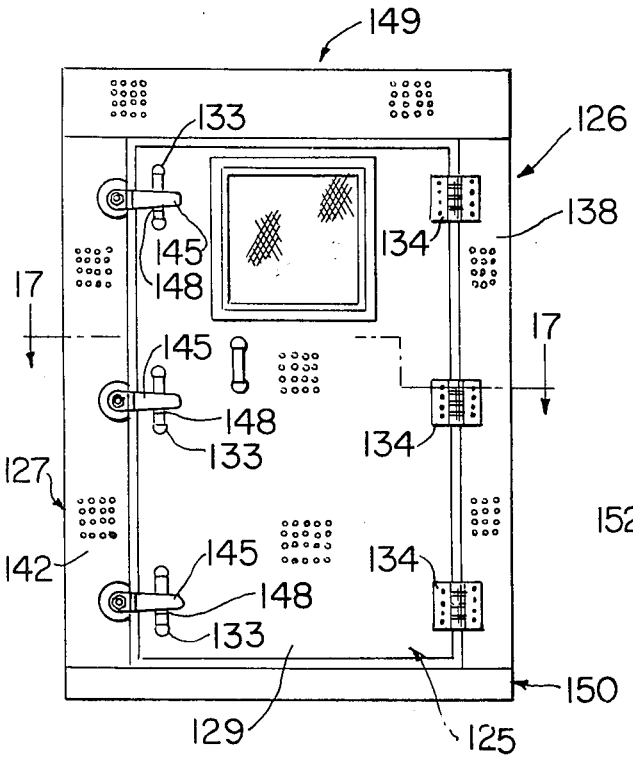
FIG. 16 is an elevational view of a swing-in door as viewed from the inside of the enclosure.
Figure 17:
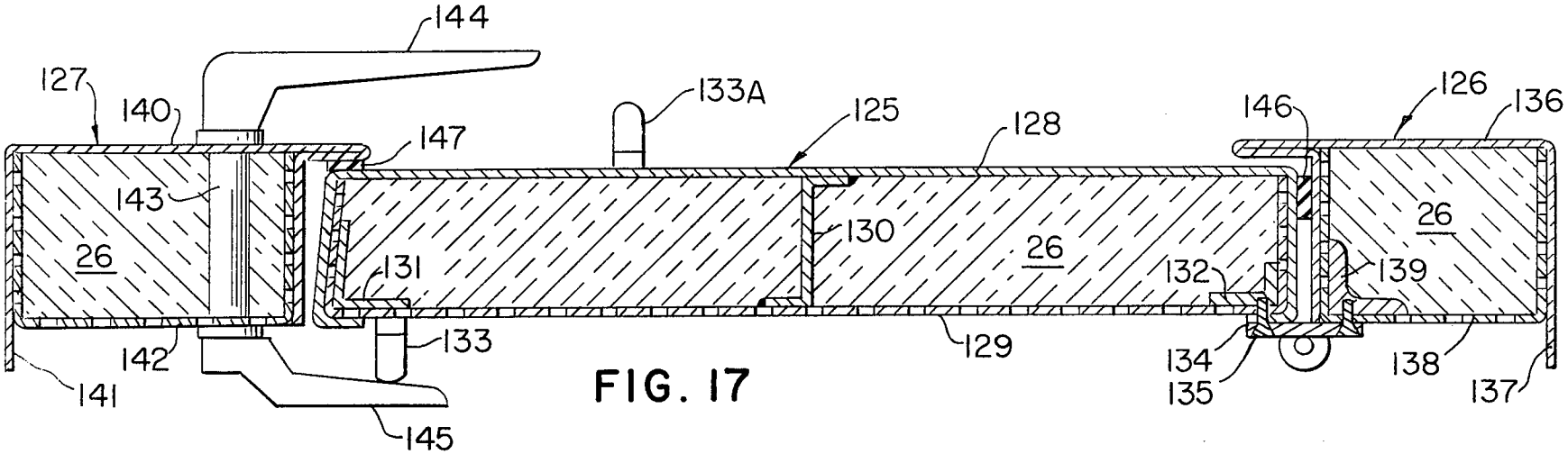
FIG. 17 is a sectional view taken along the line 17—17 of FIG. 16.

Referring now to FIGS. 16 and 17, an exemplary embodiment illustrating a swing-in type door which may be used in enclosure 10 is seen. The door designated generally as 125 is mounted between door jambs 126 and 127. With particular reference to FIG. 17, it is seen that the door 125 is comprised of a solid facing 128 which has ends encompassing the perforated facing 129. A stiffener 130 is secured between the facings 128 and 129 and the insulating material 26 is carried between the respective facings. Backup angle members 131 and 132 are secured to the inside of the perforated facing 129. The backup angles 131 and 132 provide added strength to the door 125 and permit the mounting of the handles 133 by any suitable means and the hinges 134, as will be described hereinbelow. In addition, a door pull 133A is secured to facing 128 which is grasped to open or close the door from the exterior of the structure.

The door jamb 126 includes the exterior solid facing 136 which has a solid return face 137 which will cooperate with the return face of an adjoining panel and will be brazed thereto. The door jamb 126 further comprises the perforated facing 138, insulating material 126 and a backup angle member 139 secured to the facing 138. The backup angle member 139 adds rigidity and strength to the door jamb 126 so that the door jamb can readily support the door 125 which is mounted thereto by the hinge 134.

Referring now particularly to FIG. 17, the method of securing the respective hinge to the door and door jamb will be described. Holes are drilled through the respective facings and into the backup angle members 132 and 139 to correspond with countersink type holes in the hinges. The hinges are secured thereto by a brazing process. In other words, the braze 135 completely fills the holes therethrough thereby providing a solid brazing connection between the respective hinge and the angle backing member. The braze is ground off flush with the surface of the hinge so that no protruding head exists. The brazed hinges provide a stronger mounting for the door since doors of this type may weigh approximately 250 lbs. The brazed hinges will not sag and thereby permit a good seal between the door 125 and respective gaskets. To hang or remove a door, it is only necessary to remove the hinge pins (not shown) in a known manner.

The door jamb 127 includes a solid outer facing 140 which provides a solid face 141 for cooperative engagement with a like face of the adjoining wall panel and is secured thereto by brazing. A perforated facing 142 is mounted within the facing 140 and suitable insulating material 26 is carried therewithin. A sleeve 143 is mounted in the door jamb 127 and sealingly secured therein by brazing. Mounted through the sleeve 143 is a shaft (not shown) connecting locking levers 144 and 145. Suitable seals and gaskets (not shown) are provided to insure that no air passes through the sleeve 143.

Suitable gaskets 146 and 147 of neophrene or the like are respectively secured to the solid facings 136 and 140 to cooperatively engage the solid facing 128 of the door 125 when the door is in the closed position thereby providing an airtight seal. Similar gaskets are mounted relative to the top and bottom of the door to provide top and bottom seals.

Referring once again to FIG. 16, it is seen that the door 125 is supported by three hinges 134 and further includes three handle positions. Each handle 133 is provided with a stop 148 to limit the rotational movement of the respective handles. In addition, each locking lever 145 frictionally engages its respective handle 133 to bias the door 125 into engagement with the respective gaskets to provide the airtight seal. The use of the three locking lever positions insures that a uniform pressure will be exerted against the door to insure the airtight seal.

Referring again to FIG. 16, it can be seen that top and bottom door jambs 149 and 150 cooperate with vertical door jambs 126 and 127 to completely enclose the door 125. The door jambs 149 and 150 are of a construction similar to the door jamb 126 and need not be discussed herein. Use of the prefabricated panel door jambs 126, 127, 149 and 150 eliminate the need for a separate door frame structure since the panels themselves form the frame for the door and further cooperate with the door to provide the needed airtight construction.

Figure 18:
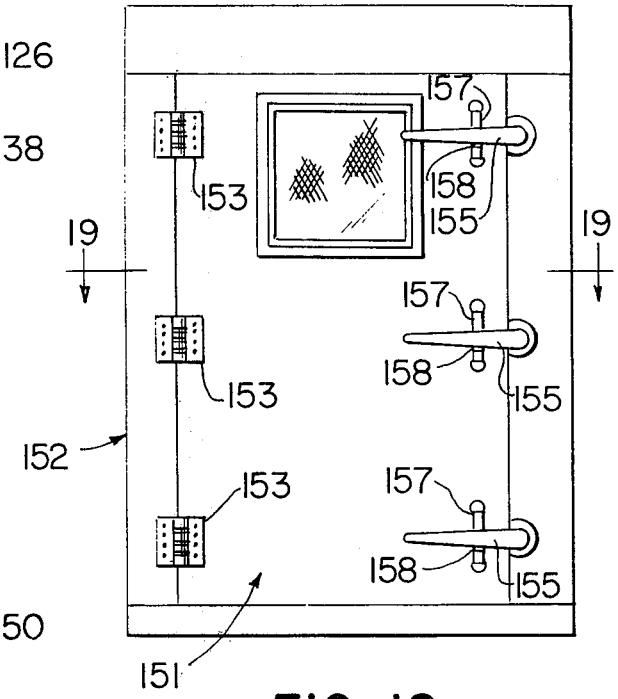
FIG. 18 is an elevational view of a swing-out door taken from the outside of the enclosure.
Figure 19:
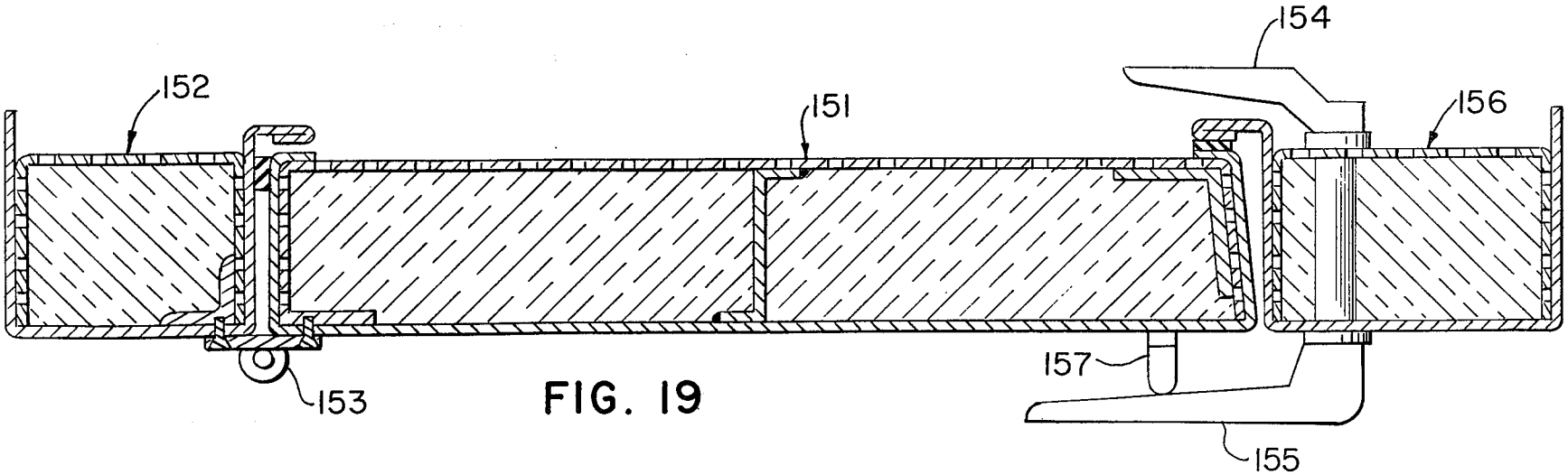
FIG. 19 is a sectional view taken along line 19—19 of FIG. 18.

FIGS. 18 and 19 illustrate a door construction very similar to that illustrated in FIGS. 16 and 17. The door designated generally as 151 is mounted to door jamb 152 by hinges 153 in the manner hereinabove described. Locking levers 154 and 155 are mounted to door jamb 156 in a like manner and cooperate with handles 157, said handles having stop elements 158 attached thereto. The major difference between doors 151 and 125 is that the door 151 is a swing-out type door. Thus, the hinges 153 are mounted on the solid facing side of the respective door jamb 152 and door 151 and the handles 157 are mounted to the outer solid facing of door 151. The operation of the door 151 is identical with the operation of the swing-in door and need not be described again.

Figure 20:
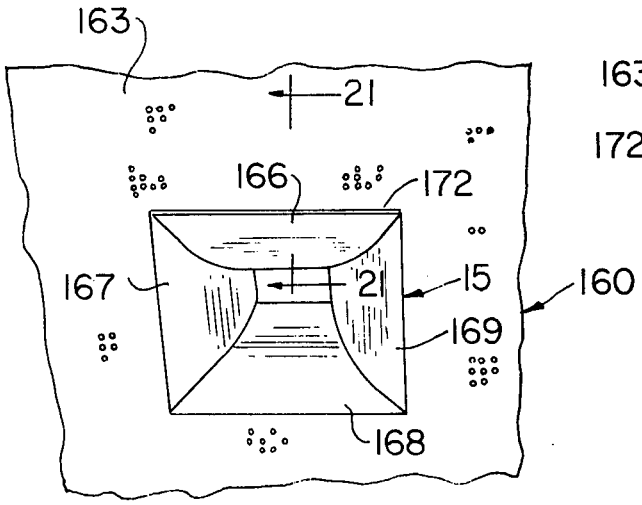
FIG. 20 is a perspective view of an illustrative panel incorporating a rectangular bellmouth.
Figure 21:
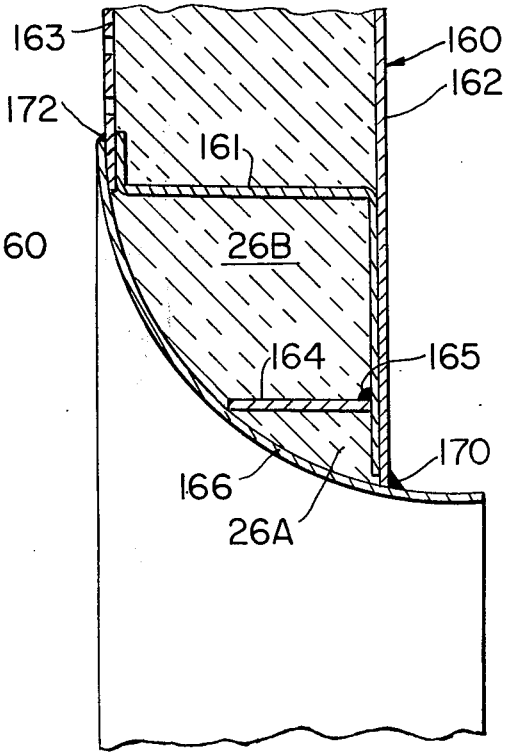
FIG. 21 is a fragmentary sectional view taken along line 21—21 of FIG. 20.

A rectangular bellmouth 15, as shown in FIG. 1, is utilized to communicate with an exit air duct 159. The purpose of the bellmouth is to provide a smooth air flow passage through the wall of the enclosure 10. The construction of the wall panel 160 incorporating the rectangular bellmouth 15 is best seen in FIGS. 20 and 21. The wall panel 160 is a standard wall panel which has been modified to incorporate the bellmouth 15 therein. Only that portion of the panel 160 directly relating to the bellmouth construction will be described herein, it being understood that the peripheral construction of the panel 160 is similar to wall panels previously described.

As particularly seen in FIG. 21, the wall panel 160 includes a stiffener 161 secured between solid facing 162 and perforated facing 163. A reinforcing bar 164 is secured to the base of the reinforcing bar 161, such as by brazing as indicated at 165, and projects outwardly therefrom. The aperture for the bellmouth is formed of solid facing members 166, 167, 168 and 169. To construct the bellmouth 15, the respective solid faces 166–169 are initially continuously Everdur brazed to the solid facing 162 as shown by brazing bead 170. The required insulating material 26A is then added and the solid face 166 is bent so as to engage the end of reinforcing bar 164. The required insulating material 26B is then added and the inner edge of the face of 166 is continuously Everdur brazed to the perforated face 163 as indicated at 172. The remaining three faces may then be added and the resulting seams between the respective faces are Everdur brazed over their entire length so as to provide an airtight construction. The reinforcing bars 164 provide added strength to the bellmouth 15, as well as insuring a smooth curvilinear transition from the inside opening of the wall panel to the exit from the bellmouth.

Figure 22:
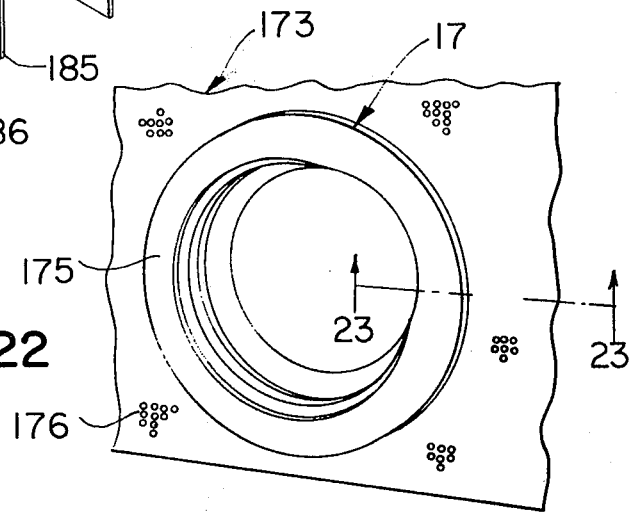
FIG. 22 is a perspective view of a panel incorporating a round bellmouth therein.
Figure 23:
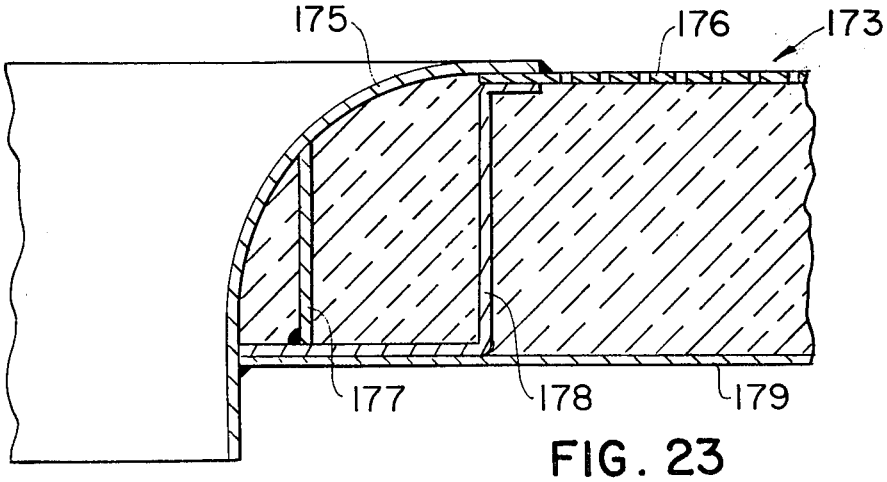
FIG. 23 is a fragmentary sectional view taken along the line 23—23 of FIG. 22.

The construction of the wall panel 173 as seen in FIGS. 22 and 23 is very similar to the wall panel 160. The wall panel 173 incorporates a round bellmouth 17 therein for those instances where it is necessary to communicate with round conduits such as illustrated at 174 in FIG. 1. An annular solid face 175 provides the curvilinear transition between the perforated face 176 of the wall panel 173 to the exterior. The reinforcing bar 177 which is Everdur brazed to the reinforcing bar 178 provides the added supporting strength for the solid face 175, as well as insuring the smooth curvilinear transition. The face 175 is brazed to the perforated facing 176 and the solid facing 179 as hereinabove described.

Figure 25:
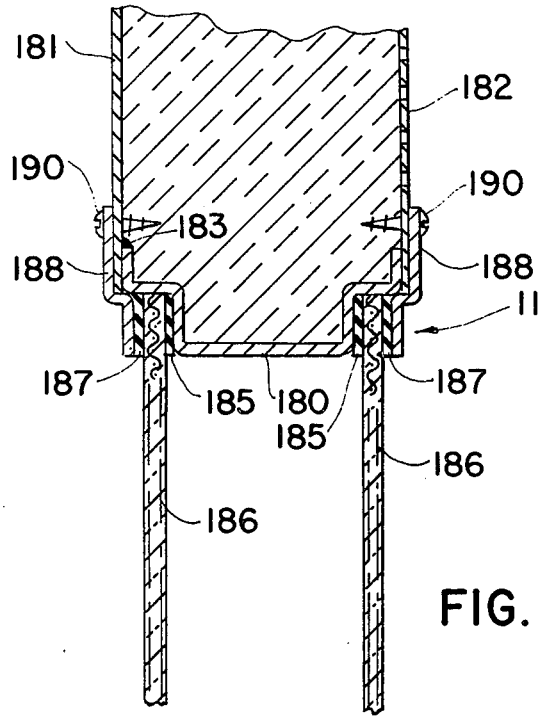
FIG. 25 is a sectional view taken along line 25—25 of FIG. 1.
Figure 24:
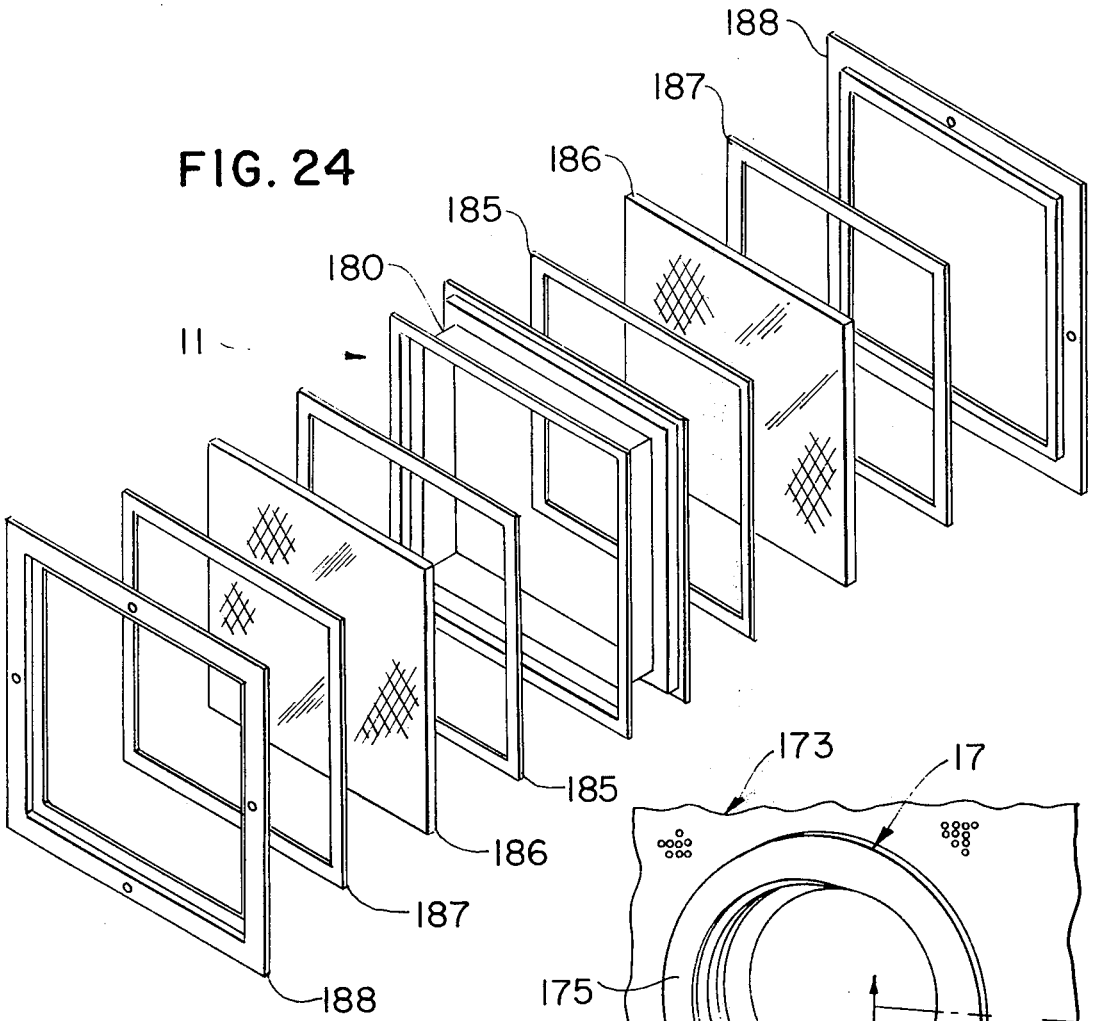
FIG. 24 is an exploded perspective view of the window structure of FIG. 1.

The basic construction of the windows 11 and 13 as seen in FIG. 1 is the same, only the dimensions are different to provide different size windows. Referring now to FIGS. 24 and 25, it can be seen that the window 11 is constructed to be soundproof, as well as leakproof. A solid frame 180 is secured to solid facing 181 and perforated facing 182 by suitable means such as continuous Everdur brazing at 183. The solid frame 180 is formed to receive gaskets 185 on opposite sides thereof. A sheet of window material such as ¼ inch wire mesh reinforced glass 186 is placed against each gasket 185. A second gasket 187 is installed about the periphery of each glass 186. Holding frames 188 are secured to the respective facings 181 and 182 by suitable means such as screws or the like 190. The holding frames 188 urge the respective gaskets 185, 187 and glass 186 inwardly in sealing engagement against the frame 180 so as to provide the soundproof and airtight window construction required for enclosure 10.

Figure 26:
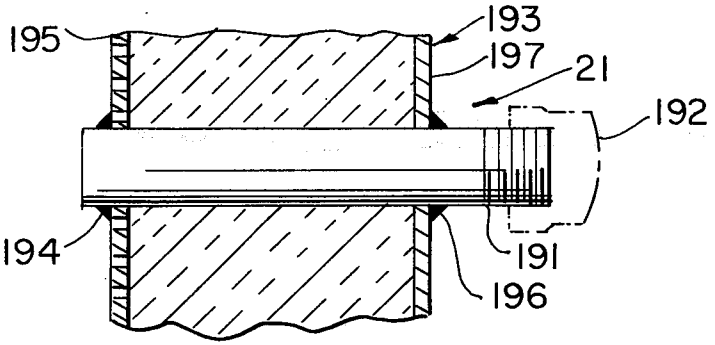
FIG. 26 is a sectional view of the test plug construction to permit the taking of samples from within the enclosure.

The test plug 21 (FIG. 1) is secured in a wall panel as shown in FIG. 26. The test plug 21 comprises a cylindrical tube or pipe 191 having a threaded cap 192 removably secured to the end thereof. The pipe 191 projects through the wall panel 193. In order to provide the required airtight construction, the pipe 191 can be tack brazed at 194 to the perforated facing 195, whereas a continuous bead of Everdur braze 196 secures the pipe 191 to the solid facing 197. Thus, after the enclosure has been completed and is in operation, the cap 192 may be removed from the pipe 191 and samples of the interior atmosphere of the enclosure may be taken through the pipe.

Figure 27:
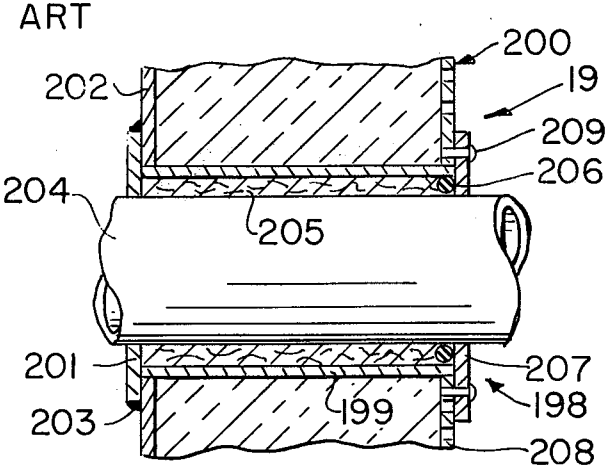
FIG. 27 is a sectional view showing a conduit sealing structure.

Conduit passages such as shown at 19 in FIG. 1 are provided through the wall panels through the use of a stuffing gland shown generally as 198 in FIG. 27. The stuffing gland 198 is comprised of a sleeve 199 mounted through the wall panel 200. Plate 201 is sealingly secured to the solid facing 202 by a continuous bead of Everdur braze 203 about the periphery of the plate 201. The plate 201 is formed with an aperture therethrough through which the conduit 204 can pass. To assure an airtight seal in the gland 198, a suitable sealing material such as Oakum packing 205 is mounted between the sleeve 199 and the conduit 204. A suitable gasket or seal 206 is held in place against the packing 205 by plate 207. The plate 207 is secured to the perforated facing 208 by suitable means such as screws or the like 209 (FIG. 5).

Figure 28:
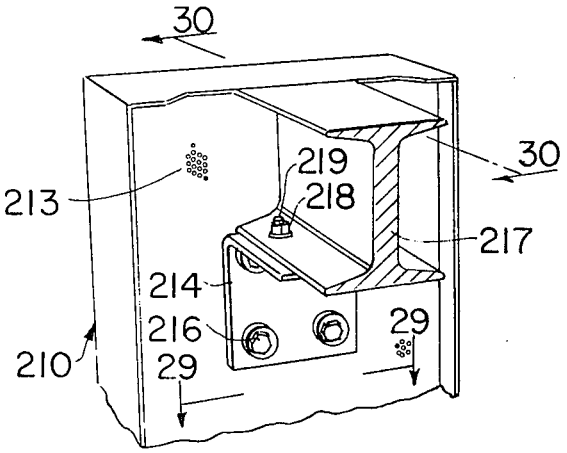
FIG. 28 is a fragmentary perspective view illustrating a ceiling support.
Figure 29:
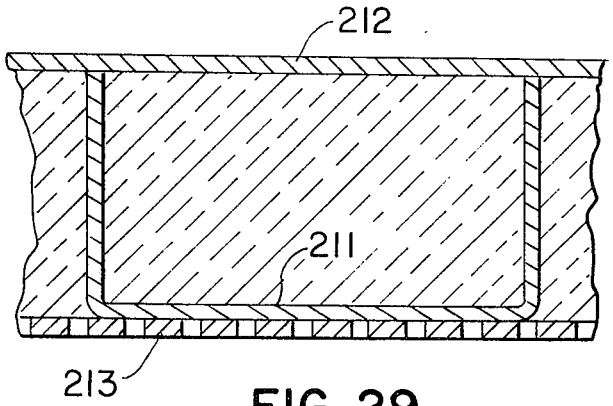
FIG. 29 is a sectional view taken along line 29—29 of FIG. 28.
Figure 30:
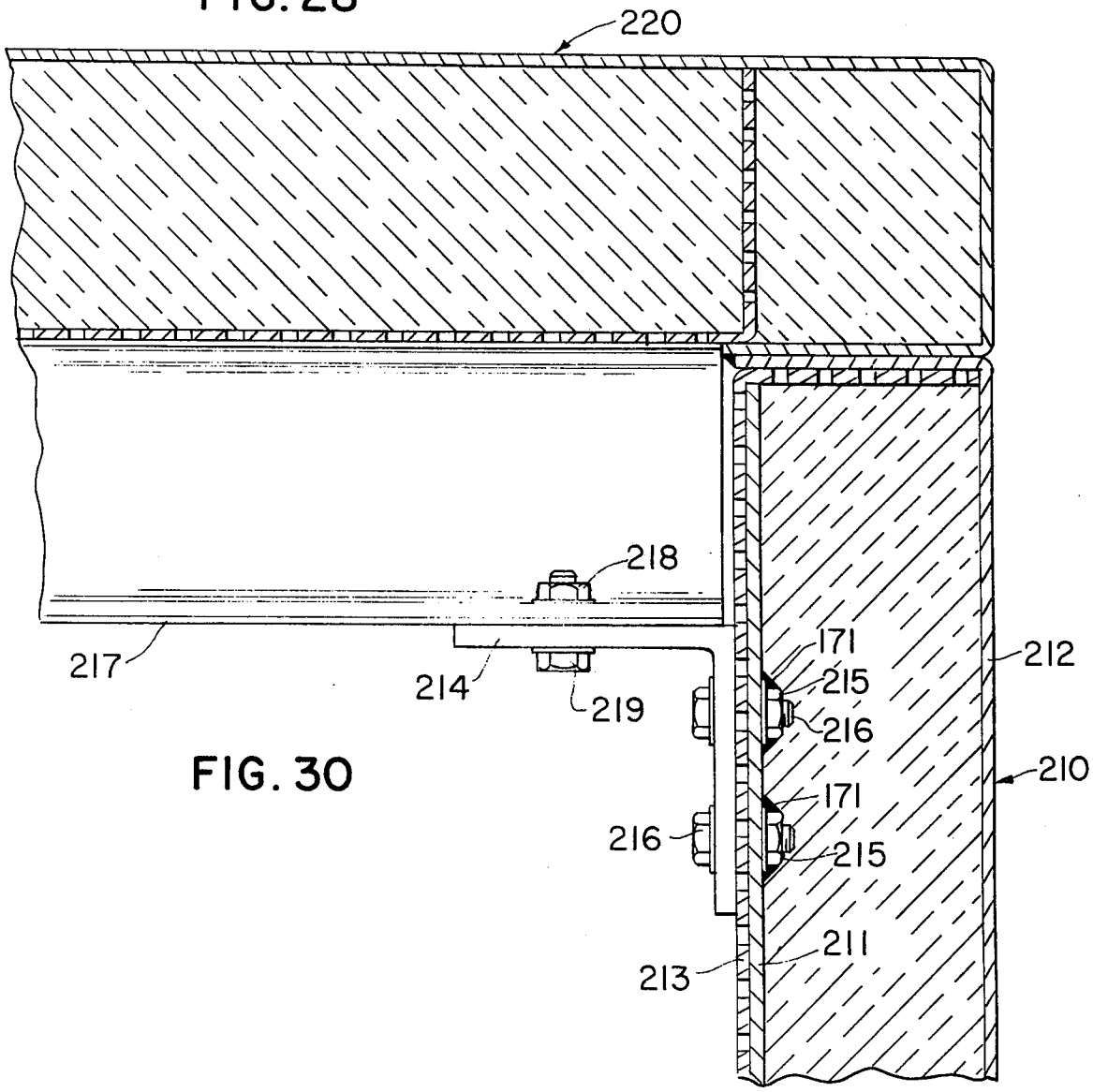
FIG. 30 is a sectional view taken along line 30—30 of FIG. 28.

The ceiling panels and wall panels previously described can be used without modification for enclosures having a span of approximately 17 feet without requiring additional ceiling supports. If an enclosure is to be of a greater length than the 17 feet, additional support is needed for the ceiling panels. In many instances it is not desirable to have a vertical post or the like within the enclosure supporting the ceiling panel. Accordingly, the modified standard wall panel 210 shown in FIGS. 28–30 permits the use of ceiling panels of lengths substantially greater than the standard 17 feet. The wall panel 210 is constructed with a solid reinforcing channel 211 secured between the outer facing 212 and the perforated facing 213. The thickness and material used in the reinforcing channel 211 will depend upon the parameters of the length of the ceiling. An angle plate 214 is secured to the perforated facing 213 by nuts and bolts 215 and 216, respectively. The nuts 215 are brazed at 171 to the inside of the reinforcing channel 211 so that the angle plate 214 may be secured thereto after the panel 210 has been constructed and assembled in place. A suitable ceiling support such as an I-beam 217 is secured to the angle plate 214 by suitable means such as nuts and bolts 218 and 219, respectively. The ceiling panel 220 is sealingly secured by continuous Everdue braze 184 to the wall panel 212 as hereinbefore described and is supported throughout its entire length by the I-beam 217. During the construction of the structure, the ceiling panel 220 is temporarily supported by suitable bracing until the panel 220 has been brazed to the wall panels 212. Once the ceiling panel 220 has been brazed to the wall panels, the I-beam 217 is raised into position and secured to the angle plate 214. Thus, it can be seen that in this manner any suitable lengths of ceiling panel 220 may be supported without requiring any vertical post or the like being required within the enclosure.

It should be noted herein that all of the prefabricated panels hereinabove described comprise a suitable insulating material therein even though such material has not been specifically described. Further, each panel is provided with suitable reinforcing members therein. In addition, it may be further noted that all seams formed between adjoining panels are sealed one to the other by the continuous Everdur brazing process so as to provide airtight seams between each panel. All such brazing steps required to construct the panels together are performed from one side, i.e., the inside of the enclosure. Accordingly, the objectives hereinbefore set forth have been accomplished.

While present exemplary embodiments of this invention have been illustrated and described, it will be recognized that this invention may be otherwise variously embodied and practiced by those skilled in the art.

What is claimed is:

1. An airtight and sound attenuated enclosure assembled from a plurality of prefabricated wall, ceilinng, floor and septum panels, each of said wall and ceiling panels comprising a solid exterior facing member, a perforated interior facing member formed in a substantially pan shape having bent edges therearound said bent edges extending to and engaging said exterior facing and cooperating with said exterior facing member to define a sound attenuating space therebetween, insulating material carried in said space to provide the sound attenuation, said solid facing member being a continuous sheet and including a solid return face overlapping the edges of said perforated facing member to define an individual panel, each panel providing a portion of the solid return facing extending beyond the facing surface of said perforate member and generally into the interior of said enclosure, the solid return face of one panel cooperating with a like solid return face of an adjoining panel so as to provide a multiplicity of facing members side by side and to define a seam therebetween, and means connecting said projecting faces together along said seam, said connecting means extending continuously along said seam to provide an airtight seam between the adjoining panels wherein individual panels can be removed by removing said connecting means therefrom.

2. The enclosure as set forth in claim 1 in which said sealing means is a continuous bead of brazing material.

3. The enclosure as set forth in claim 2 further comprising a corner wall panel, said corner panel including a pan shaped perforated inner facing member, a solid facing member spaced from said perforated member and having a return face extending outwardly from the edge of said pan shaped perforated member and returning to the lower surface of said perforated member to define a substantially rectangular chamber therebetween, insulating material being carried in the space defined between said perforated member and said solid facing member and in the space defined by said solid return face and said perforated member, said solid return face cooperatively receiving the end of an adjoining panel in a manner to be secured thereto.

4. The enclosure as set forth in claim 2 further comprising a corner ceiling panel in which said corner ceiling panel comprises a pan shaped perforated inner facing member, a solid facing member spaced from said perforated member and having a return face extending outwardly from the edge of said pan shaped perforated member and returning to the lower surface of said perforated member to define a substantially rectangular chamber therebetween, insulating material being carried in the space defined between said perforated member and said solid facing member and in the space defined by said solid return face and said perforated member, said solid return face cooperatively receiving the end of an adjoining panel in a manner to be secured thereto.

5. The enclosure as set forth in claim 2 comprising a modified wall panel adapted to cooperatively receive a panel perpendicular thereto, said modified panel comprising first and second pan shaped perforated facing members, a solid pan shaped member positioned between said perforated members and separating said members, a solid facing member enclosing said pan shaped members to define three chambers therein, insulating material being carried in said three chambers, said solid facing members having return faces engaging the opposite ends of said pan shaped members and projecting beyond the plane of said members, said solid pan shaped member providing a solid face to cooperatively receive an adjoining panel in perpendicular fashion thereto wherein the perpendicular panel may be sealingly secured to said solid pan shaped member.

6. The enclosure as set forth in claim 2 further comprising a modified septum panel to cooperatively receive an adjoining panel perpendicular thereto, said modified septum panel comprising first and second pan shaped perforated members, a solid pan shaped member, said first and second members and said solid member lying in a common plane, a third pan shaped perforated facing member having a dimension greater than the combined dimension of said first and second members and said solid pan shaped member wherein the open sides of said members are received within the open side of said third pan shaped open member, a solid facing member positioned between said third pan shaped member and said first and second pan shaped members and said solid pan shaped member, said solid facing members providing a solid return face projecting beyond the plane of said first and second pan shaped members, said solid pan shaped member defining a solid face to cooperatively receive the end of a perpendicularly placed panel wherein said perpendicular panel can be sealingly secured thereto.

7. The enclosure as set forth in claim 2 further comprising a floor panel adapted to be supported between two vertical wall panels, said floor panel comprising first and second perforated facing members, a solid facing member supported therebetween to define attenuating chambers on each side thereof, first and second pan shaped solid members being mounted on either side of said solid facing member, each pan shaped solid member lying in the plane of said pan shaped perforated members and being secured therein by said solid facing member, said solid pan shaped members providing panel receiving surfaces for receiving said vertical wall panels in sealing fashion thereto.

8. The enclosure as set forth in claim 2 further comprising a supporting panel, said supporting panel comprising first and second solid facing members defining an enclosed space therebetween, a reinforing support member being secured within said space and engaging the interior surface of both said facing members.

9. The enclosure as set forth in claim 2 wherein said wall panel houses a rectangular bellmouth therein.

10. The enclosure as set forth in claim 2 wherein said wall panel houses a round bellmouth.

11. The enclosure as set forth in claim 2 in which said wall panel houses a window therein.

12. The enclosure as set forth in claim 11 in which said window comprises a frame secured between said solid facing member and perforated facing member, said frame being shaped to cooperatively receive a gasket on either side thereof, a pane of glass being mounted adjacent each gasket, a second gasket opposite each pane of glass, and an exterior frame formed to urge said gaskets and window glass into engagement with said frame thereby providing an airtight window construction.

13. The enclosure as set forth in claim 2 in which said wall panel inclues a reinforcing channel for receiving and supporting an angle plate upon which a ceiling support beam can be mounted.

14. The enclosure as set forth in claim 2 further comprising first, second, third and fourth door jamb panels, said panels defining an enclosed solid door jamb frame when connected one to the other thereby providing door entrance, each of said panels including a perforated facing member mounted within a solid facing member so as to define a chamber therebetween, a door panel pivotally secured to one of said door jambs, gasket means secured to each of said door jambs for cooperative engagement with said door in the closed position to provide an air seal therebetween, and lock means cooperating between a second door jamb and said door panel to lock said door in the closed position and thereby urge said door into sealing engagement with said gasket means.

15. The enclosure as set forth in claim 14 in which said one door jamb panel includes a backup angle member secured therein, and further comprising means to pivotally secure said door panel to said one door jamb panel.

16. The enclosure as set forth in claim 15 in which said door panel includes a backup member secured therein and in which said pivotal means is a plurality of hinges, each hinge being permanently secured to said door and one door jamb panel by welding, said weld extending from the hinge into the respective backup member.

17. An airtight and sound attenuated enclosure assembled from a plurality of prefabricated wall, ceiling, floor and septum panels, each of said wall and ceiling panels comprising a solid exterior facing member, a perforated interior facing member formed in a substantially pan shape having bent edges therearound and cooperating with said exterior facing member to define a sound attenuating space therebetween, insulating material carried in said space to provide the sound attenuation, said solid facing member being a continuous sheet and including a solid return face overlapping the edges of said perforated facing member to define an individual airtight panel, each panel providing a portion of the projecting solid facing extending generally into the interior of said enclosure, the projecting face of one panel cooperating with a like projecting face of an adjoining panel so as to provide multiplicity of facing members side by side and to define a seam therebetween, a continuous bead of brazing material sealing said seam from the interior of the enclosure to provide an airtight seam between the adjoining panels wherein individual panels can be removed by removing said sealing means therefrom, septum panels separating interior chambers of the enclosure, said septum panels comprising first and second pan shaped perforated facing members of different sizes, the open side of the smaller member being complementally received in the open side of the larger member, a solid facing member positioned between said first and second members to define sound attenuation chambers on either side, said solid member having a return face projecting through the space defined by the received first and second member edges and projecting outwardly beyond the plane of the smaller of said members to provide the securing face for said septum panel.

18. The enclosure as set forth in claim 17 further comprising corner panels in which the corner panels includes one edge of said pan shaped perforated facing member serving as a stiffening member, the return face of said solid facing member extending outwardly from said edge and returning to the lower surface of said perforated member to define a substantially rectangular chamber, therebetween, insulating material being carried in the space defined therebetween, said solid return face cooperatively receiving the end of an adjoining panel in a manner to be secured thereto.

19. The panels as set forth in claim 17 in which the corner ceiling panel includes one edge of said pan shaped perforated facing member serving as a stiffening member, the return face extending outwardly from the edge of said perforated member and returning to the lower surface of said perforated member to define a substantially rectangular chamber therebetween, insulating material being carried in the space defined therebetween said solid return face cooperatively receiving the end of an adjoining panel in a manner to be secured thereto.

20. The panels as set forth in claim 17 wherein the floor panel is adapted to be supported between two vertical wall panels and in which said floor panel comprises first and second pan shaped solid members being mounted on either side of said solid facing member in abutting relationship with said perforated facing members, each pan shaped solid member lying in the plane of said pan shaped perforated members and being secured therein by said solid facing member, said solid pan shaped members providing panel receiving surfaces for receiving said vertical wall panels in sealing fashion thereto.

21. The panels as set forth in claim 17 further comprising a modified wall panel adapted to cooperatively receive a panel perpendicular thereto wherein said perforated facing member includes first and second pan shaped perforated members, a solid pan shaped member positioned between said perforated members and separating said members, said solid facing members enclosing said pan shaped members to define three chambers therein, insulating material being carried in said three chambers, and said solid pan shaped member providing a solid face to cooperatively receive an adjoining panel in perpendicular fashion thereto wherein the perpendicular panel may be sealingly secured to said solid pan shaped member.

22. The enclosure as set forth in claim 17 further comprising a modified septum panel to cooperatively receive an adjoining panel perpendicular thereto wherein one of said perforated facing members includes first and second pan shaped perforated members, a solid pan shaped member, said first and second pan shaped members and said solid member lying in a common plane and defining chambers in cooperation with said solid facing member, insulating material being carried in said chambers, and said solid pan shaped member defining a solid face to cooperatively receive the end of a perpendicularly placed panel wherein said perpendicular panel can be sealingly secured thereto.

23. The panels as set forth in claim 17 further comprising a supporting panel, said supporting panel comprising first and second solid facing members defining an enclosed space therebetween, a reinforcing support member being secured within said space and engaging the interior surface of both said facing members.

24. The panels as set forth in claim 17 in which the wall panel houses a window therein, said window comprises a frame secured between said solid and perforated facing members, said frame being shaped to cooperatively receive a gasket on either side thereof, a pane of glass being mounted adjacent each gasket, a second gasket opposite each pane of glass, and an exterior frame formed to urge said gaskets and window glass into engagement with said frame thereby providing an airtight window construction.

25. The panels as set forth in claim 17 further comprising first, second, third and fourth door jamb panels, said panels defining a door entrance, each of said panels including a perforated facing member mounted within a solid facing member so as to define a chamber therebetween, a door panel pivotally secured to one of said door jambs, gasket means secured to each of said door jambs for cooperative engagement with said door in the closed position to provide an air seal therebetween, and lock means cooperating between a second door jamb and said door panel to lock said door in the closed position and thereby urge said door into sealing engagement with said gasket means.

26. The panels as set forth in claim 17 in which the wall panel further includes a reinforcing channel secured between said facing members for receiving and supporting an angle plate upon which a ceiling support beam can be mounted.

27. The panels as set forth in claim 17 in which said wall panels houses a rectangular bellmouth therein.

28. The panels as set forth in claim 17 in which said wall panel houses a round bellmouth therein.

* * * * *